US008624795B2

(12) United States Patent
Leisten

(10) Patent No.: US 8,624,795 B2
(45) Date of Patent: Jan. 7, 2014

(54) DIELECTRICALLY LOADED ANTENNA

(75) Inventor: Oliver Paul Leisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 620 days.

(21) Appl. No.: 12/720,995

(22) Filed: Mar. 10, 2010

(65) Prior Publication Data

US 2010/0231478 A1 Sep. 16, 2010

Related U.S. Application Data

(60) Provisional application No. 61/175,695, filed on May 5, 2009, provisional application No. 61/175,694, filed on May 5, 2009.

(30) Foreign Application Priority Data

Mar. 12, 2009 (GB) ..... 0904307.6
Mar. 12, 2009 (GB) ..... 0904308.4

(51) Int. Cl.
*H01Q 1/36* (2006.01)

(52) U.S. Cl.
USPC ..... 343/895; 343/893; 343/859; 343/860

(58) Field of Classification Search
USPC ..... 343/859, 860, 893, 895
See application file for complete search history.

(56) References Cited

U.S. PATENT DOCUMENTS 5,828,348 A 10/1998 Tassoudji et al.
5,986,616 A 11/1999 Edvardsson
5,986,620 A 11/1999 Filipovic
5,990,847 A 11/1999 Filipovic et al.
6,005,521 A 12/1999 Suguro et al.
6,181,295 B1 1/2001 Sharaiha et al.
6,181,297 B1 1/2001 Leisten
6,229,499 B1 5/2001 Licul et al.
6,300,917 B1 10/2001 Leisten et al.
6,421,028 B1 * 7/2002 Ohgren et al. ..... 343/895

(Continued)

FOREIGN PATENT DOCUMENTS

EP 1 076 378 A1 2/2001
EP 1 147 571 B1 10/2001

(Continued)

OTHER PUBLICATIONS

Search Report for Application No. GB 0904308.4 dated Jun. 30, 2009.

(Continued)

*Primary Examiner* — Vibol Tan
(74) *Attorney, Agent, or Firm* — Alston & Bird LLP

(57) ABSTRACT

A dual-band dielectrically loaded multifilar antenna has a first group of helical conductive antenna elements extending from feed connection nodes to an annular linking conductor 20U, and a second group of conductive helical antenna elements extending from the feed coupling nodes in the direction of the linking conductor to substantially open-circuit ends spaced from the linking conductor. The helical elements of the first group are half-turn elements having an electrical length of approximately one half wavelength at a first operating frequency of the antenna. The helical elements of the second group are approximately quarter-turn helical elements having an electrical length in the region of one quarter wavelength and a second operating frequency of the antenna. Each group of elements is associated with a respective mode of resonance for circularly polarized radiation.

26 Claims, 8 Drawing Sheets

(56) References Cited

U.S. PATENT DOCUMENTS

| | | | | |
|---|---|---|---|---|
| 6,608,604 | B1 | 8/2003 | Sharaiha et al. | |
| 7,151,505 | B2 * | 12/2006 | Jostell et al. | 343/895 |
| 7,372,427 | B2 | 5/2008 | Leisten | |
| 7,515,113 | B2 * | 4/2009 | Petros | 343/833 |
| 7,817,101 | B2 * | 10/2010 | Cowles | 343/895 |
| 8,089,421 | B2 * | 1/2012 | Leisten et al. | 343/895 |
| 2002/0000949 | A1 | 1/2002 | Nishino et al. | |
| 2006/0022891 | A1 | 2/2006 | O'Neill et al. | |
| 2006/0082517 | A1 | 4/2006 | Chung et al. | |
| 2007/0063919 | A1 * | 3/2007 | Leisten et al. | 343/895 |
| 2008/0174501 | A1 * | 7/2008 | Licul et al. | 343/703 |

FOREIGN PATENT DOCUMENTS

| | | | |
|---|---|---|---|
| GB | 2 292 638 | A | 2/1996 |
| GB | 2 310 543 | A | 8/1997 |
| GB | 2 311 675 | A | 10/1997 |
| GB | 2 367 429 | B | 8/2003 |
| GB | 2 399 948 | B | 9/2004 |
| GB | 2 420 230 | A | 5/2006 |
| GB | 2 424 521 | A | 9/2006 |
| GB | 2 437 998 | A | 11/2007 |
| GB | 2 444 388 | A1 | 6/2008 |
| GB | 2 445 478 | A | 7/2008 |
| JP | 10-013148 | | 1/1998 |
| JP | 11-509076 | A | 8/1999 |
| KR | 20080027052 | A | 3/2008 |
| WO | WO-97/41695 | A2 | 11/1997 |
| WO | WO 99/33146 | A1 | 7/1999 |
| WO | WO 2006/045769 | A1 | 5/2006 |
| WO | WO 2006/136809 | A1 | 12/2006 |
| WO | WO-2008/084205 | A1 | 7/2008 |
| WO | WO 2008/111799 | A1 | 9/2008 |

OTHER PUBLICATIONS

Search Report for Application No. GB 0904307.6 dated Apr. 30, 2009.

International Search Report for Application No. PCT/GB2010/000415 mailed Jun. 23, 2010.

United Kingdom Search Report for Application No. GB1003911.3 dated Jun. 16, 2010.

Examination Report for Application No. GB 1011226.6 dated Sep. 27, 2012.

* cited by examiner

DIELECTRICALLY LOADED ANTENNA

CROSS-REFERENCE TO RELATED APPLICATIONS

The present application claims priority from U.S. Provisional Patent Applications Nos. 61/175,695 and 61/175,694, both of which were filed on May 5, 2009, and the entire disclosures of which are incorporated by reference herein.

FIELD OF THE INVENTION

This invention relates to a dielectrically-loaded antenna for operation at frequencies in excess of 200 MHz, and primarily but not exclusively to a multi-filar helical antenna for operation with circularly polarised electromagnetic radiation.

BACKGROUND OF THE INVENTION

Dielectrically-loaded quadrifilar helical antennas are disclosed in British Patent Applications Nos. 2292638A, 2310543A, and 2367429A and International Application No. WO2006/136809, the latter being related to U.S. patent application Ser. No. 11/472,586 filed Jun. 21, 2006. Such antennas are intended mainly for receiving circularly polarised signals from a global navigation satellite system (GNSS), e.g. from the satellites of the Global Positioning System (GPS) satellite constellation for position fixing and navigation purposes. GPS in the L1 band and the corresponding Galileo service are narrowband services. There are other satellite-based services requiring receiving or transmitting apparatus of greater fractional bandwidth than that available from the prior antennas. One antenna offering increased bandwidth is that disclosed in British Patent Application No. 2424521A. A dual band dielectrically loaded antenna system is disclosed in British Patent Application No. 2311675A. An antenna capable of receiving circularly polarised signals and having a resonant ring conductor is disclosed in European Patent Application No. 1147571A.

Related antennas are disclosed in British Patent Application No. 2445478A and related U.S. patent application Ser. No. 11/970,740 filed Jan. 8, 2008. These applications disclose hexafilar and octafilar antennas offering greater bandwidth and/or higher gain than a comparable quadrifilar antenna. A high-impedance quadrifilar antenna is disclosed in British Patent Application No. 2444388A and related U.S. patent application Ser. No. 11/998,471 filed Nov. 28, 2007.

The entire disclosures of the above applications are incorporated in that of the present application as filed by reference.

It is an object of the present invention to provide an antenna capable of receiving circularly polarised radiation at first and second resonant frequencies.

SUMMARY OF THE INVENTION

According to a first aspect of this invention, a dielectrically-loaded antenna for operation at frequencies above 200 MHz comprises: an electrically insulative dielectric core of a solid material that has a relative dielectric constant greater than 5 and occupies the major part of the interior volume defined by the core outer surface, which outer surface has oppositely directed transversely extending surface portions and a side surface portion between the transversely extending portions, wherein the antenna further comprises feed connection nodes associated with one of the transversely extending surface portions, a linking conductor at a location spaced from the feed connection nodes, and an antenna element structure comprising: a first group of elongate conductive antenna elements extending from the feed connection nodes over the core side surface portion to the linking conductor, and a second group of elongate conductive antenna elements extending from the feed connection nodes over the side surface portion in the direction of the linking conductor to open-circuit ends spaced from the linking conductor. In a preferred embodiment of the invention for operation with circularly polarised radiation, the antenna elements of the first group form part of conductive loops extending from one feed connection node of a balanced feed to the other feed connection node via the linking conductor, which loops each have an effective electrical length in the region of $\lambda_{g1}$, where $\lambda_{g1}$ is the guide wavelength along the loops at a first operating frequency. Each loop preferably includes two helical conductors each of an electrical length $m\lambda_{g1}/2$ where m is an integer. The antenna elements of the second group have an electrical length in the region of $(2n-1)\lambda_{g2}/4$, where $\lambda_{g2}$ is the guide wavelength along the elements of the second group at a second operating frequency and n is an integer. Accordingly, the first and second operating frequencies are those of first and second resonant modes associated respectively with the first and second groups of elongate conductive antenna elements.

In the preferred antenna, the antenna element structure provides a hybrid arrangement of a hexafilar helical antenna and a quadrifilar helical antenna, one having closed-circuit half-wave half-turn elements and the other having quarter-wave quarter-turn open-circuit helices interleaved with the closed-circuit helices on a common cylindrical side surface of the core. The helical elements of the first group and those of the second group are substantially uniformly distributed in each case around the core so that, in the case of an antenna with ten helical elements, being a hybrid of hexafilar and quadrifilar antenna element structures, the elements of each group are, in terms of the angles subtended at the core axis by neighbouring elements of the respective group within 25° of strict uniformity in any given plane perpendicular to the axis.

In common with the antenna elements of a prior hexafilar helical antenna for circularly polarised radiation as disclosed in GB2445478A, the helical elements of the first group comprise three pairs of such elements, each pair having a slightly different electrical length, with the elements of each pair being diametrically opposed to each other in any given plane perpendicular to the core axis. It is notable that, in the preferred antenna in accordance with the invention, a similar variation in electrical length applies to the elements of the second group, i.e. such elements comprise two pairs of helical elements, the electrical lengths of the elements of one of these pairs being greater than those of the elements of the other pair. In this way, it is possible to produce a phase progression between the voltages and currents in the elements of each group, so that the elements of each group are resonant in a circularly polarised resonant mode at a respective frequency dependent upon, inter alia, the electrical lengths of the elements.

The preferred antenna in accordance with the invention has a linking conductor in the form of a balun sleeve encircling the core, this sleeve acting as a common interconnecting conductor for the antenna elements of the first group. A particularly beneficial radiation pattern in each of the circularly polarised resonant modes associated with the antenna elements of the first group and the antenna elements of the second group respectively is produced where the sleeve rim has an electrical length of $\lambda_{g1}$, where $\lambda_{g1}$ is the guide wavelength of the rim at a frequency within a first operating frequency band containing the first operating frequency.

Advantageously, the second operating frequency, i.e. that determined by the open-circuit elements of the second group, is below the first operating frequency in the frequency spectrum (the latter being determined by the closed-circuit helical elements of the first group). The preferred antenna has a second operating frequency band containing the second operating frequency, this second operating frequency band being below the first operating frequency band. Typically, the centre frequencies of the first and second operating frequency bands are separated by at least 5 percent of the mean of the two centre frequencies.

According to another aspect of the invention, there is provided a dielectrically loaded helical antenna for operation in first and second frequency bands above 500 MHz, which frequency bands have respective centre frequencies spaced apart by a least five percent of the mean of the two centre frequencies, wherein the antenna comprises a core made of a solid dielectric material which occupies the major part of the interior volume of the core defined by its outer surface, and an antenna element structure comprising a plurality of closed circuit substantially half-wave helical conductive elements defining a resonant frequency in the first band and a plurality of open-circuit substantially quarter-wave helical elements defining a resonant frequency in the second band.

The invention also includes a dielectrically loaded antenna for operation at a frequency above 200 MHz, wherein the antenna comprises an electrically insulative dielectric core of a solid material that has a relative dielectric constant greater than 5 and occupies the major part of the interior volume defined by the core outer surface, which outer surface has oppositely directed transversely extending surface portions and a side surface portion between the transversely extending surface portions, wherein the antenna further comprises feed connection nodes associated with one of the transversely extending surface portions, and an antenna element structure comprising at least one pair of conductive elongate antenna elements extending from the feed connection nodes, over the side surface portion of the core towards the said other transversely extending surface portion, and terminating in open-circuit ends, wherein each of the said elongate elements has an electrical length in the region of $(2n-1)\lambda_g/4$, where $\lambda_g$ is the guide wavelength along the elements at the operating frequency and n is an integer, n being preferably equal to 1. Advantageously, the antenna has two such pairs of conductive elongate antenna elements and the electrical lengths of the elements of one of the pairs are greater than those of the other pair, and the antenna is adapted for operation with circularly polarised radiation at the said frequency of operation.

It is preferred that elongate conductive antenna elements are substantially uniformly spaced around the cylindrical side surface portion of a core that is cylindrical, each antenna element being substantially helical and centred on the axis of the cylindrical core.

Although the preferred antenna in accordance with the invention is a backfire antenna, i.e. one in which the feed connection nodes are at a distal end surface portion of the core and a feed line passes through the core from one end surface portion to the other, it is also possible to construct a so-called endfire antenna in accordance with the invention by coupling feed connection nodes on a proximal end surface portion of the core to a balun either formed directly on the proximal surface of the core or on a printed circuit board forming part of an antenna assembly comprising the combination of the antenna and a printed circuit board attached to the core.

The preferred antenna, however, in common with that of antennas disclosed in the above-mentioned prior art specifications, has a sleeve balun which is coupled at a proximal end surface portion of the core to the outer conductor of a coaxial feed line passing through the core.

Best results are obtained if a reactive matching network is interposed between the feed line and the feed connection nodes, e.g. as disclosed generally in the above-mentioned WO2006/136809. The matching network typically includes at least one shunt capacitance and, preferably, at least one series inductance. Advantageous matching of the antenna element structure to the feed line in both bands of operation of the antenna is achieved with a two-pole LC matching network having a first shunt capacitance connected across the conductors of the feed line, first and second series inductances between one of the feed line conductors and the antenna elements, and a second shunt capacitance connected to the junction of the two inductances. The network has the effect not only of matching the impedance of the antenna element structure in the two bands but also improves the radiation pattern obtained in the second frequency band of operation, i.e. according to the resonant mode determined by the open-circuit helical elements of the second group.

According to yet a further aspect of the invention, a dielectrically loaded antenna for operation in first and second frequency bands above 200 MHz comprises an electrically insulative dielectric core of a solid material that has a relative dielectric constant greater than 5 and occupies the major part of the interior volume defined by the core outer surface, which outer surface has oppositely directed transversely extending surface portions and a side surface portion between the transversely extending portions, wherein the antenna further comprises a pair of feed coupling nodes associated with one of the transversely extending surface portions, and an antenna element structure comprising first and second groups of elongate conductive antenna elements, each group comprising at least four such antenna elements extending from the feed coupling nodes over the core side surface portion towards the other transversely extending surface portion, wherein the elements of the first group are longer than those of the second group whereby the elements of the first and second groups are respectively associated with first and second circular polarisation resonances of different resonant frequencies, and wherein each group of antenna elements has elements connected to one of the feed coupling nodes and elements connected to the other of the feed coupling nodes, the arrangement of the elements being such that, in respect the elements connected to each feed coupling node, (a) they comprise pairs of neighbouring antenna elements, with each pair comprising one element of the first group and one element of the second group, and (b) the number of said pairs in which, in a given direction around the core, the element of the first group precedes the element of the second group is equal to the number of said pairs in which, in the said direction, the element of the second group precedes the element of the first group.

It is preferred that, in respect of the elements connected to each feed coupling node, the elements of the first group and those of the second group are arranged in an alternating sequence around the side surface portion of the core.

The above-recited pairs of neighbouring antenna elements generally include at least three pairs in each of which one of the elements is also an element of another such pair.

The invention has particular use in dual-service applications for receiving signals from or transmitting signals to a satellite in spaced apart frequency bands. Once such dual-service application is for simultaneous reception of global navigation satellite system (GNSS) signals in two bands, e.g. in the L1 and L2 bands respectively (at 1575.42 MHz and 1277.60 MHz) used by the GPS and Galileo systems. Other applications of the antenna include handheld and mobile transceivers for S- and L-band satellite telephone services employing neighbouring uplink and downlink . . . frequency bands such as the TerreStar S-band service having uplink and downlink bands centred on 2.005 GHz and 2.195 GHz. Operating the open-circuit antenna elements as quarterwave elements allows them to be dimensioned to resonate at a much lower frequency than the half-wave closed-circuit elements despite being on the same outer surface portion of the core. In one alternative embodiment the closed-circuit element may be fullwave or one-and-a-half wave elements, leaving room for quarterwave open-circuit elements tuned to one half of the resonant frequency of the closed-circuit elements, or even lower. Typically, in an antenna in accordance with the invention, having a first band of operation centred on a first resonant frequency $f_1$ and a second band of operation centred on a second resonant frequency $f_2$, the frequency separation of $f_2-f_1$ of the two centre frequencies is less than 25 percent of the mean frequency $\frac{1}{2}(f_1+f_2)$.

The invention will be described below by way of example with reference to the drawings.

DETAILED DESCRIPTION OF THE PREFERRED EMBODIMENTS OF THE INVENTION

Figure 1:
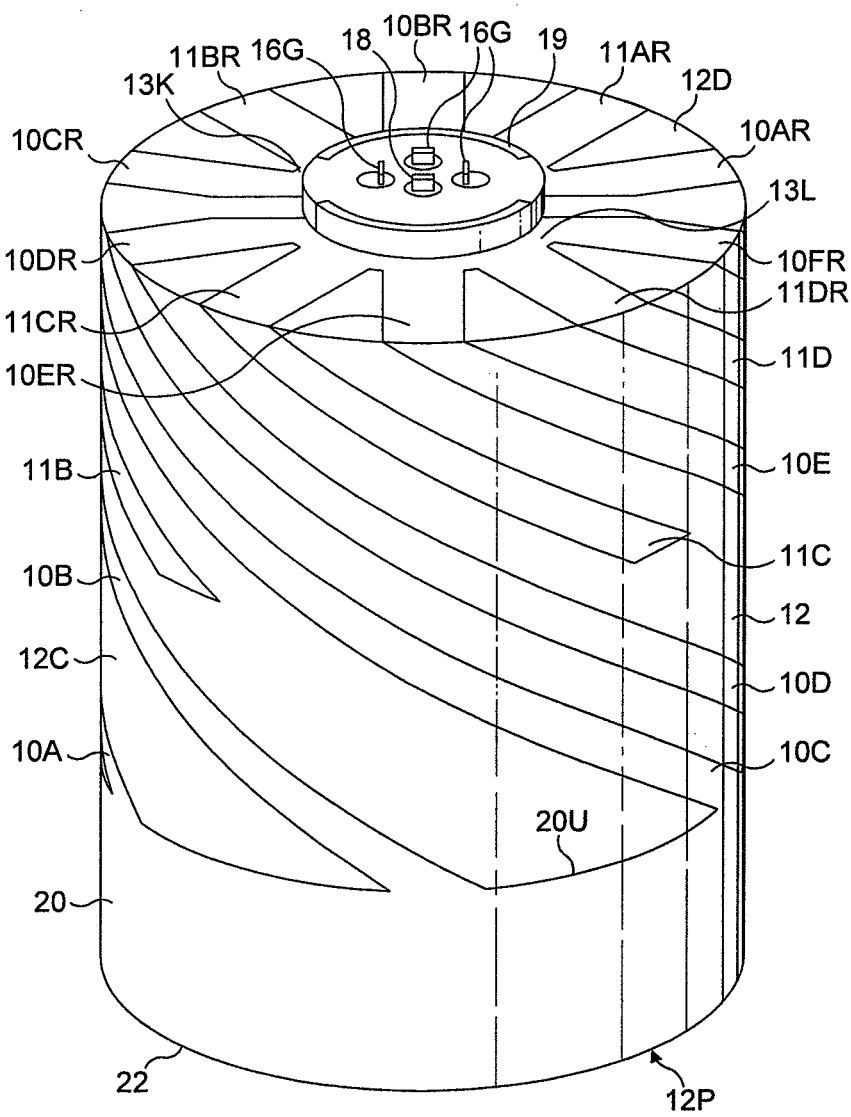
FIG. 1 is a perspective view of an antenna in accordance with the invention.
Figure 2:
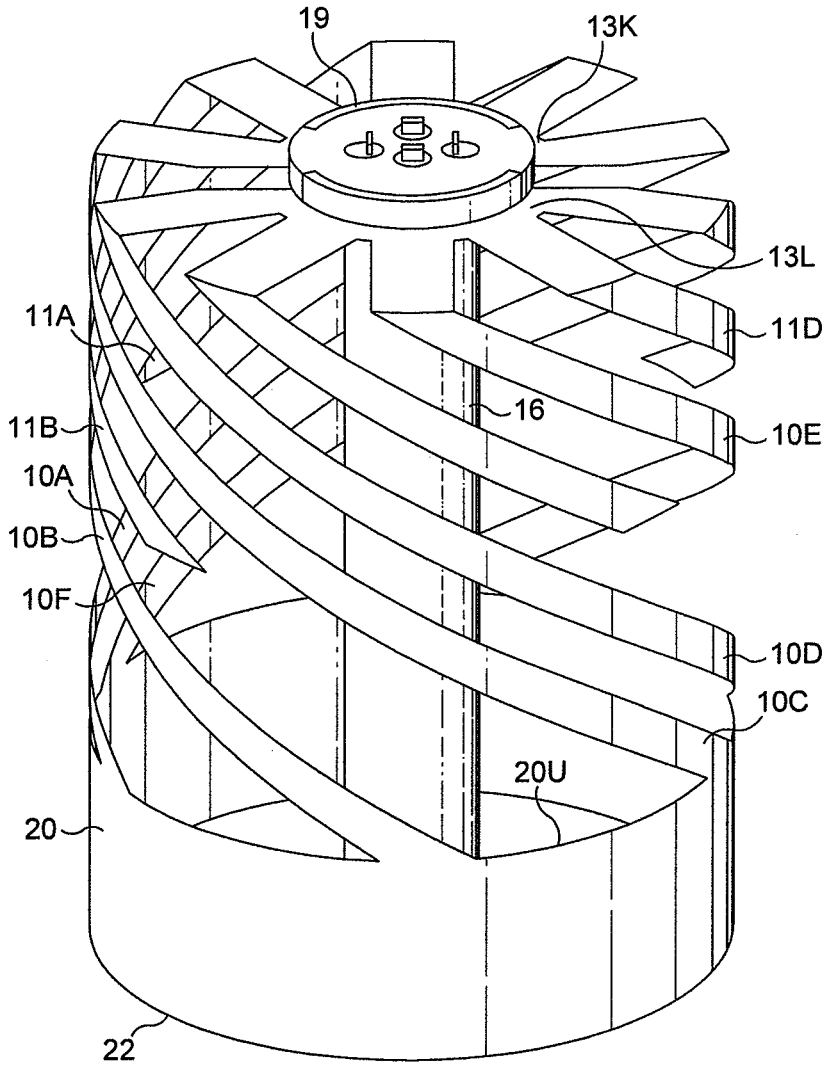
FIG. 2 is a see-through perspective view of the antenna of FIG. 1.
Figure 3:
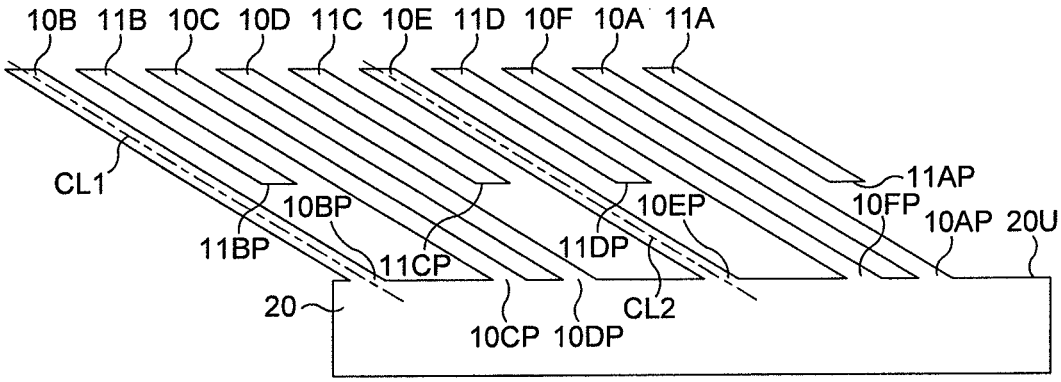
FIG. 3 is a representation of the conductor pattern on the outer cylindrical surface portion of the antenna of FIG. 1, transformed to a plane.

Referring to FIGS. 1 to 3, a multifilar helical antenna in accordance with the invention has an antenna element structure with ten elongate antenna elements constituted by two groups of such elements, one group comprising a plurality of closed-circuit helical conductive tracks 10A, 10B, 10C, 10D, 10E, 10F and a second group comprising a plurality of open-circuit helical conductive tracks 11A, 11B, 11C, 11D, these tracks all being plated or otherwise metallised on the cylindrical outer surface portion 12C of a solid cylindrical core 12. In FIG. 2, the core is omitted for clarity.

The core is made of a ceramic material. In this case it is a calcium-magnesium titanate material having a relative dielectric constant in the region of 21. This material is noted for its dimensional and electrical stability with varying temperature and low dielectric loss. In this embodiment, which is intended for operation in the GPS L2 and L1 bands (1227.6 MHz and 1575.42 MHz) the core has a diameter of 14 mm. The length of the core, at 17.75 mm, is greater than the diameter, but in other embodiments of the invention it may be less. The core is produced by pressing, but may be produced in an extrusion process, the core then being fired. In other embodiments of the invention a glass-ceramic material may be used for the core.

Figure 4:
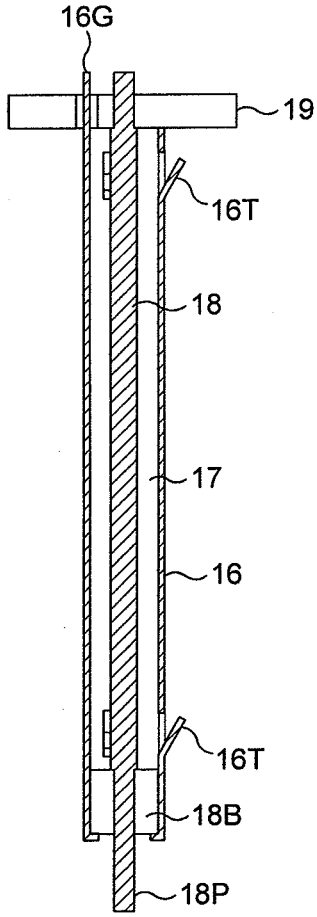
FIG. 4 is an axial cross-section of a feed structure of the antenna of FIG. 1.

This preferred antenna is a backfire helical antenna in that it has a coaxial transmission line housed in an axial bore (not shown) that passes through the core from a distal end face 12D to a proximal end face 12P of the core. Both end faces 12D, 12P are planar and perpendicular to the central axis of the core. They are oppositely directed, in that one is directed distally and the other proximally in this embodiment of the invention. The coaxial transmission line is a rigid coaxial feeder which is housed centrally in the bore with the outer shield conductor spaced from the wall of the bore so that there is, effectively, a dielectric layer between the shield conductor and the material of the core 12. Referring to FIG. 4, the coaxial transmission line feeder has a conductive tubular outer shield 16, a first tubular air gap or insulating layer 17, and an elongate inner conductor 18 which is insulated from the shield by the insulating layer 17. The shield 16 has outwardly projecting and integrally formed spring tangs 16T or spacers which space the shield from the walls of the bore. A second tubular air gap exists between the shield 16 and the wall of the bore. The insulative layer 17 may, instead, be formed as a plastics sleeve, as may the layer between the shield 16 and the walls of the bore. At the lower, proximal end of the feeder, the inner conductor 18 is centrally located within the shield 16 by an insulative bush (not shown), as described in our above-mentioned WO2006/136809.

The combination of the shield 16, inner conductor 18 and insulative layer 17 constitutes a transmission line of predetermined characteristic impedance, here 50 ohms, passing through the antenna core 12 for coupling distal ends of the antenna elements 10A-10F, 11A-11D to radio frequency (RF) circuitry of equipment to which the antenna is to be connected. The couplings between the antenna elements 10A-10F, 11A-11D and the feeder are made via conductive connection portions associated with the helical tracks 10A-10F, 11A-11D, these connection portions being formed as radial tracks 10AR, 10BR, 10CR, 10DR, 10ER, 10FR, 11AR, 11BR, 11CR, 11DR, plated on the distal end face 12D of the core 12. Each connection portion extends from a distal end of the respective helical track to one of two arcuate tracks or conductors 13K, 13L plated on the core distal face 12D adjacent the end of the bore 12B and forming feed coupling nodes.

The two arcuate conductors 13K, 13L are coupled, respectively, to the shield and inner conductors 16, 18 by conductors on a laminate board 19 secured to the core distal face 12D, as will described hereinafter. The coaxial transmission line feeder and the laminate board 19 together comprise a unitary feed structure before assembly into the core 12, and their interrelationship may be seen by comparing FIGS. 1 and 4.

Referring again to FIG. 4, the inner conductor 18 of the transmission line feeder has a proximal portion 18P which projects as a pin from the proximal face 12P of the core 12 for connection to the equipment circuitry. Similarly, integral lugs (not shown) on the proximal end of the shield 16 project beyond the core proximal face 12P for making a connection with the equipment circuitry ground.

Proximal ends 10AP-10FP (see FIG. 3) of the six closed-circuit antenna elements 10A-10F of the first group are interconnected by a common virtual ground conductor 20. In this embodiment, the common conductor is annular and in the form of a plated sleeve surrounding a proximal end portion of the core 12. This sleeve 20 is, in turn, connected to the shield conductor 16 of the feeder, where it emerges proximally from the core, by a plated conductive covering 22 of the proximal end face 12P of the core 12 (FIG. 1).

The six closed-circuit helical antenna elements 10A-10F of the first group are of different lengths, each set 10A-10C, 10D-10F of three elements having elements of slightly different lengths as a result of the rim 20U of the sleeve generally being of varying distance from the proximal end face 12P of the core. Where the shortest elements 10A, 10D are connected to the sleeve 20, the rim 20U is a little further from the proximal face 12P than where the longest antenna elements 10C, 10F are connected to the sleeve 20. The differing lengths of the conductive paths containing the closed-circuit helical antenna elements 10A-10F result in phase differences between the currents in the elements within each set 10A-10C, 10D-10F of three elements when the antenna operates in a first mode of resonance in which the antenna is sensitive to circularly polarised signals. In this mode, currents flow around the rim 20U of the sleeve 20 between, on the one hand, the elements 10D, 10E, 10F connected to one of the feed connection nodes 13L and, on the other hand, the elements of the other of the sets 10A, 10B, 10C connected to the other feed connection node 13K.

The conductive sleeve 20, the plating 22 of the proximal end face 12P, and the outer shield 16 of the feed line 16, 18 together form a quarter-wave balun which provides common-mode isolation of the antenna element structure from the equipment to which the antenna is connected when installed. The balun converts the single-ended currents at the proximal end of the feed line 16, 18 to balanced currents at the distal end where it emerges on the distal end surface portion 12D of the core 12.

The rim 20U of the sleeve 20 has an electrical length of $\lambda_{g1}$, $\lambda_{g1}$ being the guide wavelength for currents passing around the rim 20U at the frequency of the first resonant mode of the antenna, so that the rim exhibits a ring resonance at that frequency. The operation of the sleeve rim 20U as a resonant element is described in more detail in the above-mentioned EP1147571A.

Whilst the sleeve and plating of this embodiment of the invention are advantageous in that they provide both a balun function and a ring resonance, a ring resonance can also be provided independently by connecting the helical elements 10A-10F to an annular conductor which encircles the core 12 and has both proximal and distal edges on the outer side surface portion of the core, rather than being in the form of a sleeve connected to the feeder shield conductor 16 to form an open-ended cavity, as in the present embodiment. Such a conductor may be comparatively narrow insofar as it may constitute an annular track the width of which is similar to the width of conductive tracks forming the helical elements 10A-10F, 11A-11D and, providing it has an electrical length corresponding to the guide wavelength at an operating frequency of the antenna, still produces a ring resonance reinforcing the resonant mode associated with the loops provided by the helical elements 10A-10F and their interconnection, i.e. the first resonant mode.

The sleeve 20 and proximal surface plating 22 act as a trap preventing the flow of currents from the closed-circuit antenna elements 10A-10F to the shield 16 of the feed line at the proximal end face 12P of the core. It will be noted that the closed-circuit helical tracks 10A-10F are interconnected in sets of three by the arcuate tracks 13K, 13L constituting the feed coupling nodes between the inner ends of the respective radial tracks 10AR, 10BR, 10CR, 10DR, 10ER, 10FR, so that each subset of closed-circuit helical tracks typically has one long track 10C; 10F, one intermediate length track 10B; 10E and one short track 10A; 10D.

The three conductive loops between the two feed coupling nodes 13K, 13L formed, respectively, by (a) the shortest closed-circuit helical conductor tracks 10A, 10D and the sleeve rim 20U, (b) intermediate length closed-circuit helical conductor tracks 10B, 10E and the sleeve rim 20U, and (c) the longest closed-circuit helical conductor tracks 10C, 10F and the sleeve rim 20U each have an effective electrical length approximately equal to $\lambda_{g1}$, which is the guide wavelength along the loops at the frequency of the first resonant mode. The elements are half-turn elements and are coextensive on the cylindrical surface portion 12C of the core. The configurations of the closed-circuit helical tracks 10A-10F and their interconnection are such that they operate similarly to a simple dielectrically loaded hexafilar helical antenna, the operation of which is described in more detail in the above-mentioned GB2445478A.

In contrast to the closed-circuit helical conductor tracks 10A-10F, the other helical conductor tracks 11A-11D have open-circuit proximal ends 11AP, 11BP, 11CP, 11DP on the core cylindrical surface portion 12C at locations between the distal end surface portion of the core and the sleeve rim 20U, as shown in FIGS. 1, 2 and 3. The arrangement of these open-circuit helical tracks is such that they are also uniformly distributed around the core, being interleaved between the closed-circuit helical tracks 10A-10F, each open-circuit track 11A-11D executing approximately a quarter-turn around the axis of the core. Being uniformly distributed around the axis of the core, the open-circuit helical tracks 11A-11D comprise generally orthogonally located track pairs 11A,11C; 11B, 11D. Each open-circuit track 11A-11D forms, in combination with its respective radial connection element 11AR-11DR on the core distal end surface portion 12D, a quarter-wave monopole in the sense that the electrical length of each track is approximately equal to one quarter of the guide wavelength $\lambda_{g2}$ along the tracks at the frequency of a second circularly polarised resonant mode of the antenna determined inter alia by the length of the open-circuit elements.

As is the case with the closed-circuit helical conductor tracks 10A-10F, the open-circuit tracks 11A-11D also exhibit small differences in physical and electrical length. Thus, the open-circuit tracks include a first pair of diametrically opposed tracks 11A, 11C which are longer than a second pair of diametrically opposed tracks 11B, 11D. These small variations in length phase-advance and phase-retard their respective individual resonances to synthesise a rotating dipole at the frequency of the second circularly polarised resonant mode.

It should be noted that, in this embodiment of the invention, the frequency of the second resonant mode is lower than that of the first resonant mode.

Since there is no connection of the system of monopole elements formed by the open-circuit helical tracks 11A-11D and their respective radial tracks 11AR-11DR to the sleeve rim 20U, the second circularly polarised resonant mode is determined independently of the ring resonance of the sleeve rim 20U. Nevertheless, the presence of the balun formed by the sleeve 20, the feeder 16, 18 and their interconnection by the plated layer 22 of the proximal end surface portion 12P of the core, reducing as it does the effect of the self-capacitance of the shield conductor 16, improves the matching of the quadrifilar monopoles 11A-11D, thereby producing a stable circularly polarised radiation pattern in the second resonant mode. In addition, the tolerances on the monopole lengths are less critical as a result.

In this specification, the term "radiation" and "radiating" are to be construed broadly in the sense that, when applied to characteristics or elements of the antenna, they refer to characteristics or elements of the antenna associated with the radiation of energy when it is used with a transmitter or which are associated with the absorption of energy from the surroundings when the antenna is used with a receiver.

In respect of the five antenna elements 10A, 11A, 10B, 11B, 10C; 10D, 11C, 10E, 11D, 10F connected to each feed coupling node 13K; 13L, the sequence of closed-circuit tracks 10A, 10B, 10C; 10D, 10E, 10F and open-circuit tracks 11A, 11B; 11C, 11D respectively around the core is such that it is symmetrical about a centre line CL1; CL2 (see FIG. 3). In other words, for each feed coupling node, the sequence is mirrored about the respective centre line. More particularly, the arrangement of the antenna elements is such that, in respect of the elements connected to each feed coupling node, they comprise pairs of neighbouring antenna elements, each pair comprising one closed-circuit antenna element and one open-circuit antenna element, and the sequence of antenna elements is such that, in a given direction around the core, the number of pairs in which a closed-circuit element precedes an open-circuit element is equal to the number of pairs in which, in the same direction the open circuit element precedes the closed circuit element. Bearing in mind that, in the present context, each such "pair" of elements can include at least one element which is also an element of another such pair, the antenna elements coupled to the first feed coupling node 13K comprises four pairs 10A, 11A; 11A, 10B; 10B, 11B; and 11B, 10C. Of these four pairs, viewing the sequence from above the antenna (i.e. from a position located distally of the distal core surface portion 12D) in an anticlockwise direction there are two pairs 10A, 11A; 10B, 11B in which the closed-circuit element precedes the open circuit element and two pairs 11A, 10B; 11B, 10C in which the open-circuit element precedes the closed-circuit element, thereby satisfying the condition of equal numbers of pairs, as specified above. The same is true of the antenna elements connected to the other feed coupling node 13L. Thus, there are two pairs 10D, 11C; 10E, 11D in which the closed-circuit element precedes the open-circuit element and two pairs 11C, 10E, 11D, 10F in which the open-circuit element precedes the closed-circuit element. This sequencing of closed-circuit and open-circuit elements has been found to produce a superior radiation pattern in comparison to an antenna which does not meet this condition.

It is possible to meet the condition with an antenna having four closed-circuit elements and four open-circuit elements only, as will be described below. However, the combination of six elements of one kind and four of the other kind, i.e. in this case, six closed-circuit elements and four open-circuit elements, is preferred because a more uniform spacing of the elements of each group 10A-10F; 11A-11D can be obtained. Accordingly, given that the complete set of antenna elements 10A-10F, 11A-11D is uniformly distributed around the core, in any given plane perpendicular to the antenna axis, the closed-circuit helical tracks 10A-10F have angular spacings of 72° (in respect of four pairs of tracks) and 36° (in respect of two pairs of tracks). The maximum deviation from the optimum spacing of 60° is 24°. With regard to the four open-circuit helical tracks 11A-11D, the inter-element angular spacings are 72° and 108°, i.e. yielding a deviation of only 18° from the 90° optimum.

Impedance matching is performed by a matching network embodied in a laminate printed circuit board (PCB) assembly 19 mounted face-to-face on the distal end surface portion 12D of the core, as shown in FIG. 1.

The PCB assembly 19 forms part of a feed structure incorporating the feed line 16, 18, as shown in FIG. 4.

The feed line 16, 18 performs functions other than simply that of a line having a characteristic impedance of 50 ohms for conveying signals to or from the antenna element structure. Firstly, as described above, the shield 16 acts in combination with the sleeve 20 to provide common-mode isolation at the point of connection of the feed structure to the antenna element structure. The length of the shield conductor between (a) its connection with the plating 22 on the proximal end face 12P of the core and (b) its connection to conductors on the PCB assembly 19, together with the dimensions of the axial bore (in which the feeder transmission line is housed) and the dielectric constant of the material filling the space between the shield 16 and the wall of the bore, are such that the electrical length of the shield 16 on its outer surface is a quarter wavelength at each of the frequencies of the two required modes of resonance of the antenna, so that the combination of the conductive sleeve 20, the plating 22 and the shield 16 produces balanced currents at the connection of the feed structure to the antenna element structure.

In this preferred antenna, there is an insulative layer surrounding the shield 16 of the feed structure. This layer, which is of lower dielectric constant than the dielectric constant of the core 12, and is an air layer in the preferred antenna, diminishes the effect of the core 12 on the electrical length of the shield 16 and, therefore, on any longitudinal resonance associated with the outside of the shield 16. Since the modes of resonance associated with the required operating frequencies are characterised by voltage dipoles extending diametrically, i.e. transversely of the cylindrical core axis, the effect of the low dielectric constant sleeve on the required modes of resonance is relatively small due to the sleeve thickness being, at least in the preferred embodiment, considerably less than that of the core. It is, therefore, possible to cause the linear mode of resonance associated with the shield 16 to be de-coupled from the wanted modes of resonance.

The antenna has main resonant frequencies of greater than 500 MHz, these resonant frequencies being determined by the effective electrical lengths of the helical antenna conductor 10A-10F, 11A-11D, as described above. The electrical lengths of the elements, for a given frequency of resonance, are also dependent on the relative dielectric constant of the core material, the dimensions of the antenna being substantially reduced with respect to an air-cored quadrifilar antenna.

Antennas in accordance with the invention are especially suitable for dual-band satellite communication above about 1 GHz. In this case, the helical antenna elements 10A-10F of the first group have an average longitudinal extent (i.e. parallel to the central axis) of about 12.3 mm whilst those 11A-11D of the second group have an average longitudinal extent of about 8.0 mm. The length of the conductive sleeve 20 is typically in the region of 5.45 mm. This yields a quarterwave balun at approximately the mean of the centre frequencies of the two frequency bands of operation. This dimension is not critical. Indeed, the sleeve length may be set to yield a quarterwave balun action at either of the two centre frequencies or any frequency in between in many cases, depending on the spacing between the centre frequencies.

Precise dimensions of the antenna elements 10A-10F and 11A-11D can be determined in the design stage on a trial and error basis by undertaking empirical optimisation until the required phase differences are obtained. The diameter of the coaxial transmission line in the axial bore of the core is in the region of 2 mm.

Further details of the feed structure will now be described. As shown in FIG. 4, the feed structure comprises the combination of the coaxial 50 ohm feed line 16, 17, 18 and the planar laminate board assembly 19 connected to a distal end of the line. The PCB assembly 19 is a double-sided printed circuit board that lies flat against the distal end face 12D of the core 12 in face-to-face contact. The largest dimension of the PCB assembly 19 is smaller than the diameter of the core 12 so that the PCB assembly 19 is fully within the periphery of the distal end face 12D of the core 12, as shown in FIG. 1.

In this embodiment, the PCB assembly 19 is in the form of a disc centrally located on the distal face 12D of the core. Its diameter is such that it overlies the arcuate inter-element coupling conductors 13K, 13L plated on the core distal surface portion 12D. As shown in the exploded view of FIG. 5, the assembly 19 has a substantially central hole 32 which receives the inner conductor 18 of the coaxial feeder transmission line. Three off-centre holes 34 receive distal lugs 16G of the shield 16. The lugs 16G are bent or "jogged" to assist in locating the PCB assembly 19 with respect to the coaxial feeder structure. All four holes 32, 34 are plated through. In addition, portions 19P of the periphery of the assembly 19A, 19PB, are plated, the plating extending onto the proximal and distal faces of the laminate board.

Figure 5:
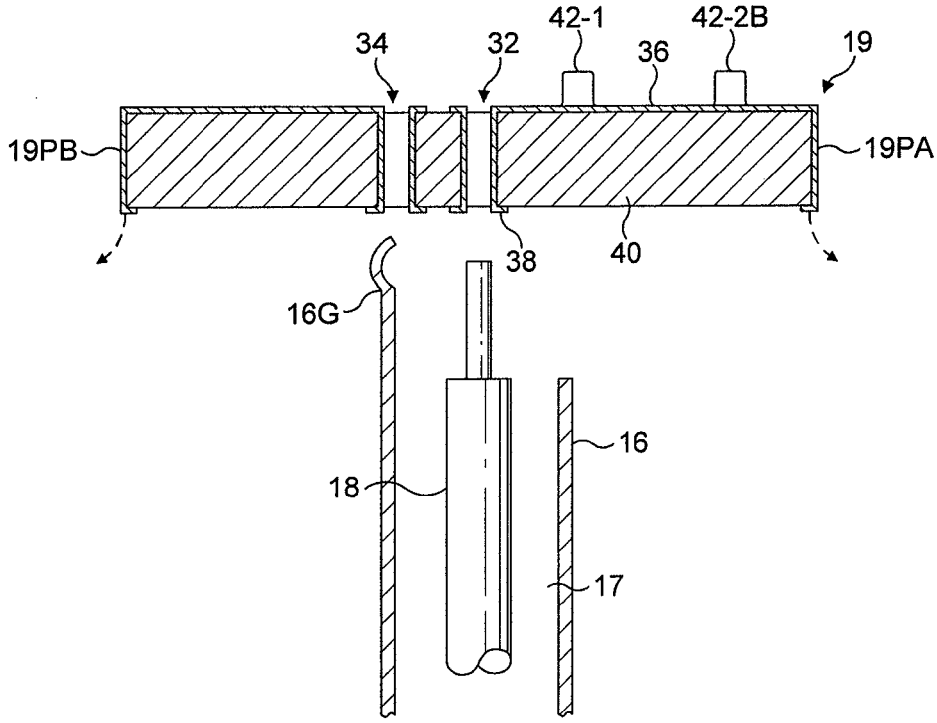
FIG. 5 is a detail of the feed structure shown in FIG. 4, showing a laminate board thereof detached from a distal end portion of a feeder transmission line.
Figure 6A:
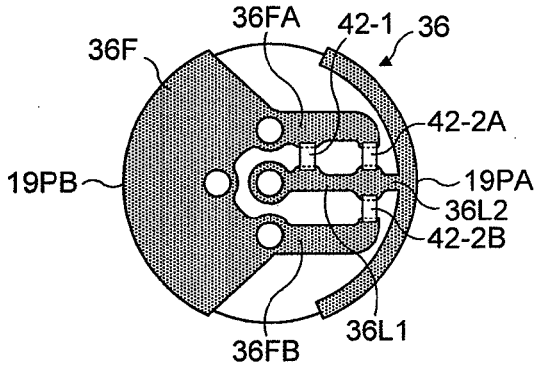
FIGS. 6A and 6B are diagrams showing conductor patterns of conductive layers of the laminate board of the feeder structure.
Figure 6B:
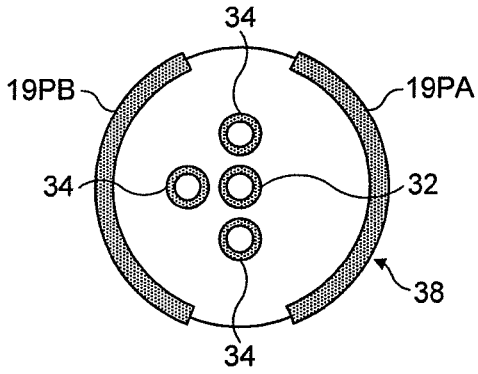

The PCB assembly 19 has a double-sided laminate board in that it has a single insulative layer and two patterned conductive layers. Additional insulative and conductive layers may be used in alternative embodiments of the invention. As shown in FIG. 5, in this embodiment, the two conductive layers comprise a distal layer 36 and a proximal layer 38 which are separated by the insulative layer 40. This insulative layer 40 is made of FR-4 glass-reinforced epoxy board. The distal and proximal conductor layers are each etched with a respective conductor pattern, as shown in FIGS. 6A and 6B respectively. Where the conductor pattern extends to the peripheral portions 19PA, 19PB of the laminate board and to the plated-through holes 32, 34, the respective conductors in the different layers are interconnected by the edge plating and the hole plating respectively. As will be seen from the drawings showing the conductor patterns of the conductor layers 36, 38, the distal conductive layer 36 has an elongate conductor track 36L1, 36L2 which connects the inner feed line conductor 18, when it is housed in the central hole 32 in the laminate board, to a first peripheral plated edge portion 19PA of the board. This elongate track is in two parts 36L1, 36L2 which, owing to their relatively narrow elongate shape constitute inductances at frequencies in operation of the antenna. Since the edge portion 19PA is connected via one 13L of the arcuate tracks to half of the radial conductors 10DR, 10ER, 10FR, 11CR, 11DR on the distal end face 12D of the core (FIG. 1), these inductances are in series between the inner feed line conductor 18 and two 10D, 10E, 10F; 11C, 11D of each of the helical antenna elements of each group 10A-10F; 11A-11D. If, in the space available on the laminate board, a single track portion 36L1, 36L2 of sufficient length to yield a required inductance cannot be accommodated, either track portion 36L1, 36L2 can be divided into two parallel track portions, i.e. with a slit between them, to produce a greater inductance per unit length.

The feed line shield 16, when housed in the holes 34 in the laminate board, is connected directly to the opposite peripheral plated edge portion 19PB of the board by a fan-shaped conductor 36F which, owing to its relatively large area, has low inductance. Accordingly, the shield is effectively connected directly to the other antenna elements 10A, 10B, 10C, 11A, 11B via the other arcuate track 13K and the respective radial conductors 10AR, 10BR, 10CR, 11AR, 11BR. The fan-shaped conductor 36F is extended towards the first peripheral plated edge portion 19PA alongside the inductive elongate track 36L1, 36L2, to provide pads for discrete shunt capacitances. Thus, in this embodiment, the fan-shaped conductor 36F has two extensions 36FA, 36FB running parallel to the inductive track 36L1, 36L2 on opposite sides thereof. Each extension 36FA, 36FB is formed as a track that is much wider and, therefore, of negligible inductance, compared to the central inductive track. One of these extensions 36FA provides pads for a first chip capacitor 42-1, connected to the plating associated with the central hole 32, and a second chip capacitor 42-2A, connected to the junction between the two inductive track parts 36L1, 36L2. The other extension 36FB provides a pad for a third chip capacitor 42-2B which is also connected to the junction between inductive track parts 36L1, 36L2. In this embodiment of the invention, the capacitors 42-1, 42-2A, 42-2B are 0201-size chip capacitors (e.g. Murata GJM).

Figure 7:
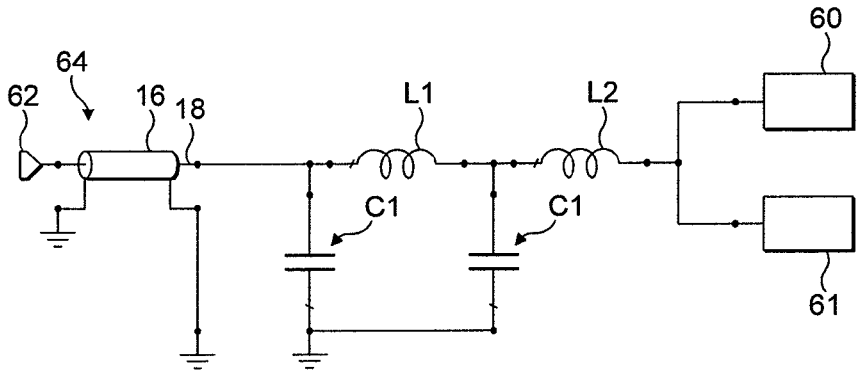
FIG. 7 is an equivalent circuit diagram.

The above-described combination constitutes a 2-pole reactive matching network shown schematically in FIG. 7. The network provides a dual-band match between (a) subcircuits 60, 61 respectively representing the source constituted by the closed-circuit helical elements 10A-10F and associated parts, and the source constituted by the open-circuit helical elements 11A-11D and associated parts, and (b) a 50 ohm load 62. In this example, the feed line 16-18 (FIGS. 4 and 5) is a 50 ohm coaxial line section 64. Inductors L1 and L2 are formed by the track sections 36L1, 36L2 referred to above. The shunt capacitance C1 is that indicated as capacitor 42-1 in FIGS. 5 and 6A. The other shunt capacitance C2 is formed by the parallel combination of the two chip capacitors 42-2A, 42-2B described above with reference to FIG. 6A. Using two capacitors for the second capacitance C2 allows a relatively high capacitance value to be obtained using low profile chip capacitors and reduces resistive losses.

Connections between the feed line 16, 18, the PCB assembly 19 and the conductive tracks on the distal face 12D of the core are made by soldering or by bonding with conductive glue. The feed line 16-18 and the assembly 19 together form a unitary feeder structure when the distal end of the inner conductor 18 is soldered in the via 32 of the laminate board, and the shield lugs 16G in the respective off-centre vias 34. The feed line 16-18 and the PCB 19 together form a unitary feed structure with an integral matching network.

The network constituted by the series inductances L1, L2 and the shunt capacitances C1, C2 forms a matching network between the radiating antenna element structure of the antenna and a 50 ohm termination at the proximal end of the transmission line section when connected to radio frequency circuitry, this 50 ohm load impedance being matched to the impedance of the antenna element structure at its operating frequencies. The shunt impedance represented by the matching network also has the beneficial effects of permitting wider tolerances for the monopole antenna elements 11A-11D, and an improved respective radiation pattern.

As stated above, the feed structure is assembled as a unit before being inserted in the antenna core 12, the laminate board of the assembly 19 being fastened to the coaxial line 16-18. Forming the feed structure as a single component, including the board 19 as an integral part, substantially reduces the assembly cost of the antenna, in that introduction of the feed structure can be performed in two movements: (i) sliding the unitary feed structure into the axial bore of the core 12 and (ii) fitting a conductive ferrule or washer around the exposed proximal end portion of the shield 16. The ferrule may be a push-fit on the shield component 16 or is crimped onto the shield. Prior to insertion of the feed structure in the core, solder paste is preferably applied to the connection portions of the antenna element structure on the distal end face 12D of the core 12 and on the plating 22 immediately adjacent the respective ends of the axial bore. Therefore, after completion of steps (i) and (ii) above, the assembly can be passed through a solder reflow oven or can be subjected to alternative soldering processes such as laser soldering, inductive soldering or hot air soldering as a single soldering step.

Solder bridges formed between (a) conductors on the peripheral and the proximal surfaces of the board 19 and (b) the metallised conductors on the distal face 12D of the core, and the shapes of the conductors themselves, are configured to provide balancing rotational meniscus forces during reflow soldering when the board is correctly orientated on the core.

Figure 8:
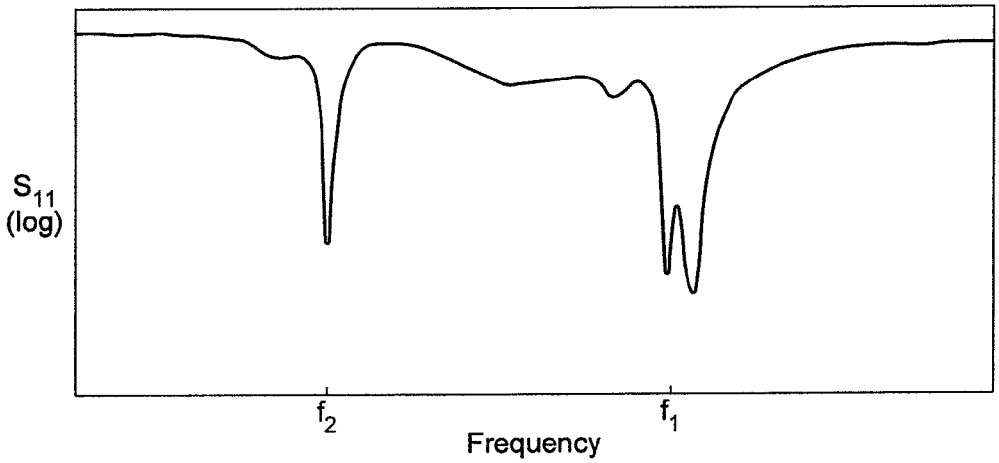
FIG. 8 is a graph illustrating the insertion loss ($S_{11}$) frequency response of the antenna of FIG. 1.

Using the structure described above, it is possible to create a dual-band circularly polarised frequency response, the insertion-loss-versus-frequency graph of the antenna being as shown in FIG. 8. The antenna has a first band centred on a upper resonant frequency $f_1$ and a second band centred on an lower resonant frequency $f_2$. In this antenna, the frequency separation $f_2-f_1$ of the two centre frequencies is about 25 percent of the mean frequency $\frac{1}{2}(f_1+f_2)$. It has a predominantly upwardly directed radiation pattern in respect of right-hand circularly polarised waves in both bands.

Figure 9:
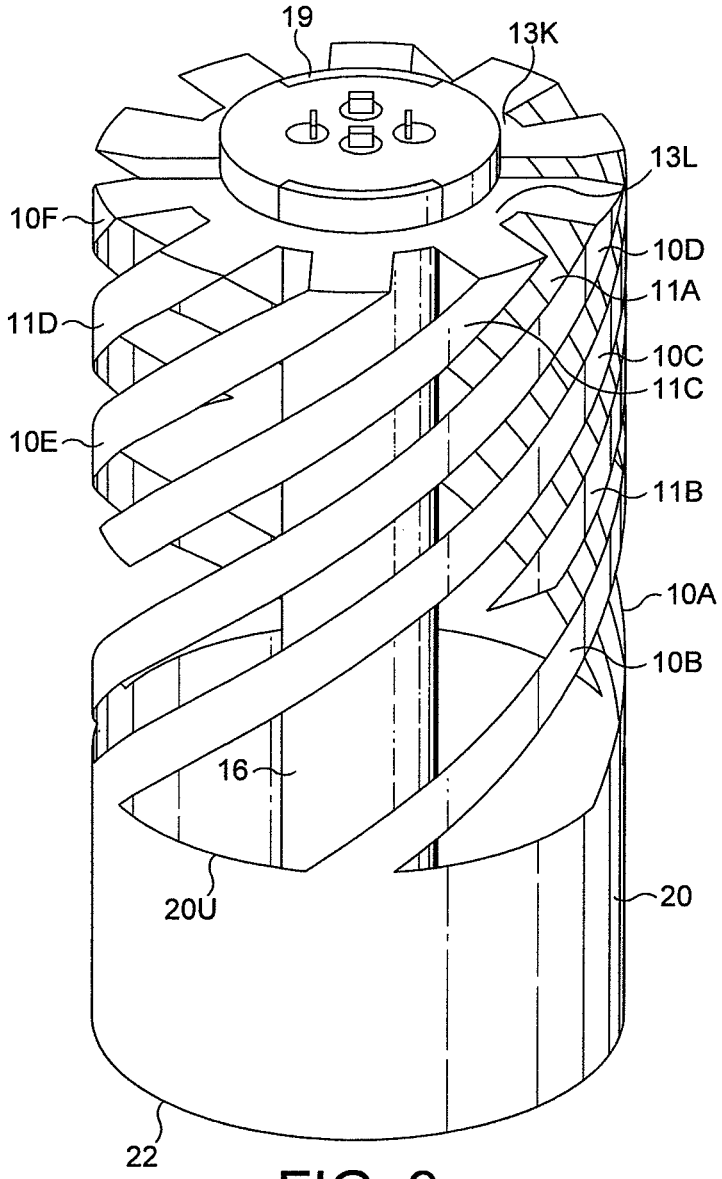
FIG. 9 is a see-through perspective view of a first alternative antenna in accordance with the invention.

It will be appreciated that an antenna in accordance with the invention can be adapted for left-hand circularly polarised waves. Such an antenna is shown in FIG. 9. The dielectric core is omitted from FIG. 9 for clarity. In practice, the helical elements of this antenna are plated in the cylindrical surface of the core as in the previous embodiment. This antenna may be used for dual-band operation with the TerreStar (Registered Trade Mark) combined satellite and terrestrial service and has closed-circuit helical tracks 10A-10F and open-circuit helical tracks 11A-11D of the opposite sense to those of the antenna described above with reference to FIGS. 1 to 8. The length and diameter of the core are 17.75 mm and 10 mm respectively in this case. As before, the relative dielectric constant of the core material is 21.

This antenna produces a predominantly upwardly directed radiation pattern in respect of left-hand circularly polarised waves in both frequency bands and, as in the antenna described above with reference to FIGS. 1 to 8, the helical tracks 10A, 10B, 10C, 11A, 11B; 10D, 10E, 10F, 11C, 11D coupled to each feed coupling node respectively have a symmetrical sequence of tracks, i.e. they form a pattern which is mirrored about the centre element in each case. As in the antenna described above with reference to FIGS. 1 to 9, the sequence of elements within the set connected to each respective feed coupling node is an alternating one: closed-circuit, open-circuit, closed-circuit, open-circuit, closed-circuit.

Figure 10:
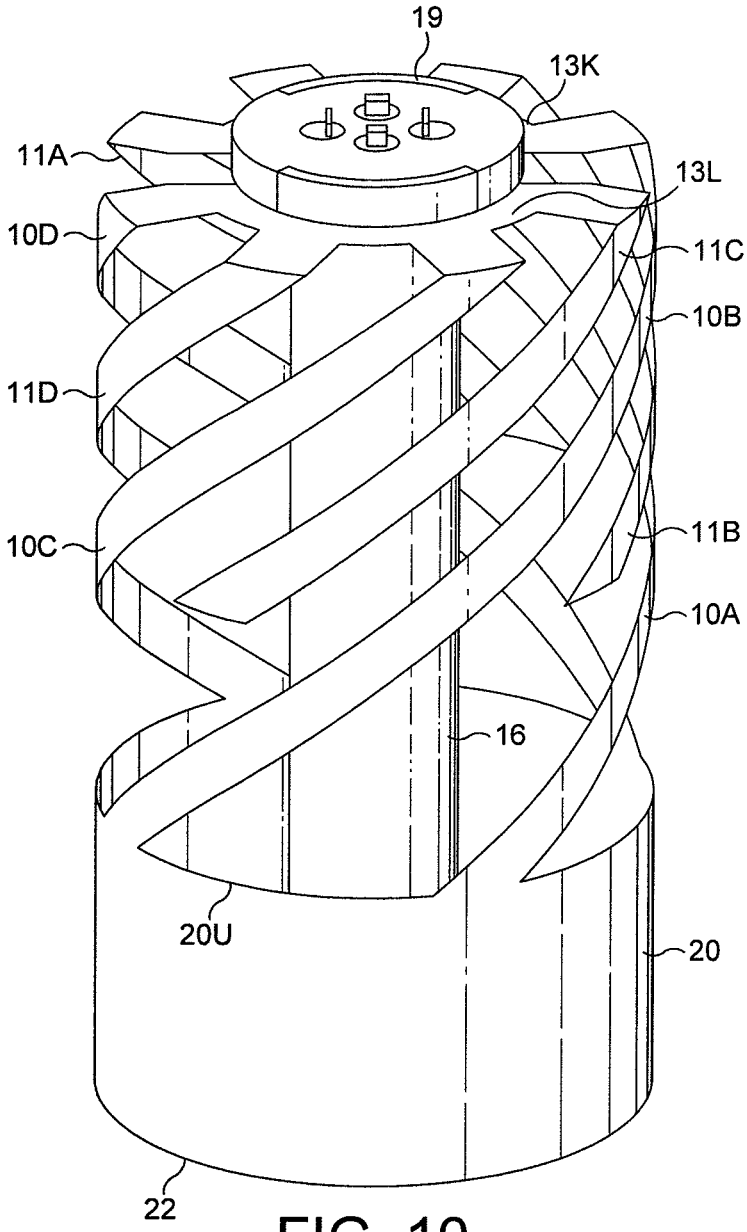
FIG. 10 is a see-through perspective view of a second alternative antenna in accordance with the invention.
Figure 11:
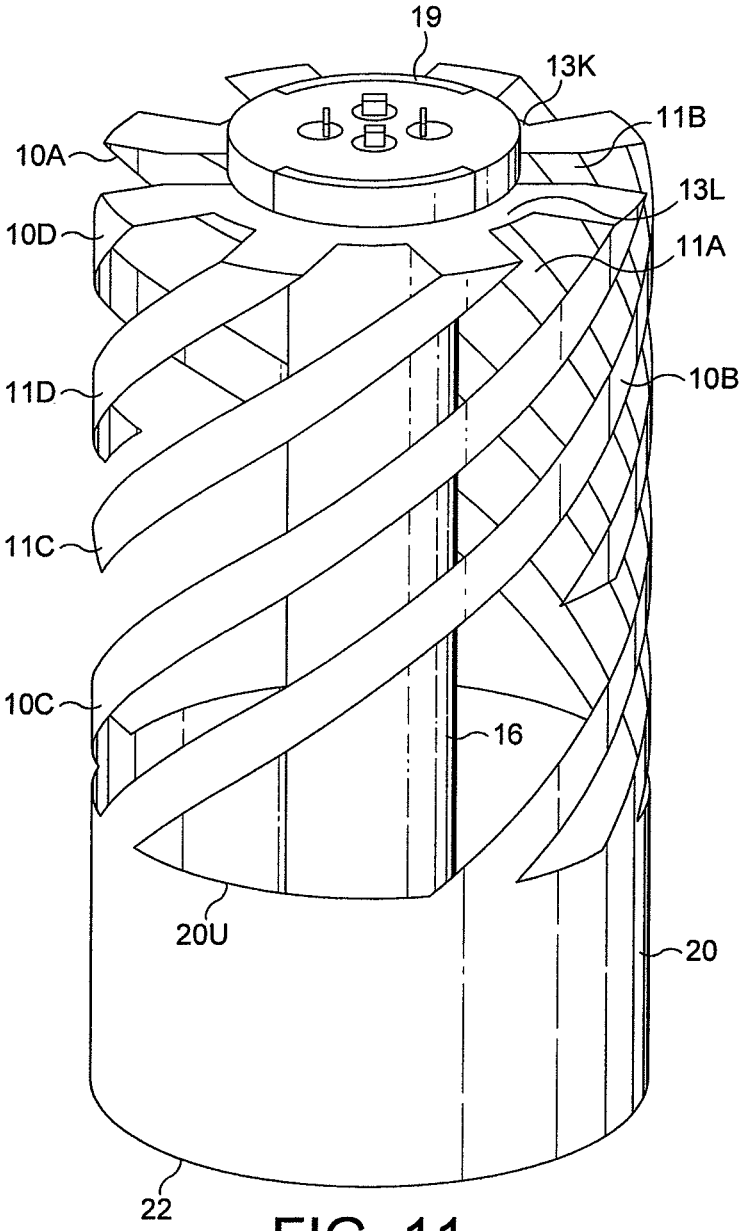
FIG. 11 is a see-through perspective view of a third alternative antenna in accordance with the invention.

As mentioned above, it is possible to construct an antenna in accordance with the invention having fewer antenna elements, e.g. with four closed-circuit elements and four open-circuit elements. Referring to FIG. 10, in a third antenna in accordance with the invention, closed-circuit and open-circuit helical elements are arranged in an alternate sequence around the core. In this case, in a clockwise direction looking from a distal viewpoint, the sequence of this antenna for left-hand circularly polarised waves is open-circuit (11A), closed-circuit (10A), open-circuit (11B), closed-circuit (10B). An equivalent sequence is used for the antenna elements connected to the other feed coupling node 13L. This arrangement does not meet the sequence symmetry condition referred to above. Instead, therefore, referring to FIG. 11, a further antenna in accordance with the invention again has four closed-circuit elements 10A-10D and four open-circuit elements 11A-11D. In this case, the pattern of elements coupled to each arcuate conductor 13K, 13L on the top face of the core is symmetrical in the sense that, within each set of elements 10A, 10B, 11A, 11B; 10C, 10D, 11C, 11D attached to a respective arcuate element 13K, 13L on the distal face of the core, the sequence of closed-circuit and open-circuit helical elements is mirrored about the centre of the respective set. Thus, in this embodiment, the sequence within each set is: closed-circuit, open-circuit, open-circuit, closed-circuit. As in FIGS. 2, 9 and 10, the antenna of FIG. 11 is shown without its dielectric core for clarity.

Other embodiments are feasible, for instance the antennas described above with reference to FIG. 1 to 9 may be modified to have six open-circuit elements and four closed-circuit elements. Note that in all of the preferred embodiments, the helical elements as a whole are uniformly angularly spaced around the antenna axis.

What is claimed is:

1. A dielectrically loaded antenna for operation at frequencies above 200 MHz, wherein the antenna comprises: an electrically insulative dielectric core of a solid material that has a relative dielectric constant greater than 5 and occupies the major part of the interior volume defined by the core outer surface, which outer surface has oppositely directed transversely extending surface portions and a side surface portion between the transversely extending portions, wherein the antenna further comprises feed coupling nodes associated with one of the transversely extending surface portions, a linking conductor at a location spaced from the feed coupling nodes, and an antenna element structure comprising:

a first group of elongate conductive antenna elements extending from the feed coupling nodes over the core side surface portion to the linking conductor, the first group of elongate conductive antenna elements operating at a first operating frequency, and a second group of elongate conductive antenna elements extending from the feed coupling nodes over the side surface portion in the direction of the linking conductor to substantially open-circuit ends spaced from the linking conductor, the second group of elongate conductive antenna elements operate at a second operating frequency, wherein the elements of at least the first group are substantially helical.

2. An antenna according to claim 1, having first and second operating frequencies, wherein the antenna elements of the first group form part of conductive loops extending from one feed connection node to the other feed connection node via the linking conductor, which loops each have an effective electrical length in the region of $\lambda_{g1}$, where $\lambda_{g1}$ is the guide wavelength along the loops at the first operating frequency, and wherein the antenna elements of the second group have an electrical length in the region of $(2n-1)\lambda_{g2}/4$, where $\lambda_{g2}$ is the guide wavelength along the elements of the second group at the second operating frequency and n is an integer.

3. An antenna according to claim 2, wherein each conductive loop includes two helical conductors each of an electrical length $m\lambda_{g2}$, where m is an integer.

4. An antenna according to claim 1, wherein, in respect of the antenna elements connected to each respective one of the feed coupling nodes, the elements of the second group are interleaved with those of the first group.

5. An antenna according to claim 1, for operation with circularly polarised radiation at first and second operating frequencies, wherein the antenna element of the first group comprise three pairs of such elements, and the antenna elements of the second group comprise two pairs of such elements.

6. An antenna according to claim 1, wherein the antenna elements of the said first group are substantially half-turn helices and the antenna elements of the said second group are substantially quarter-turn helices.

7. An antenna according to claim 1, wherein the feed coupling nodes form part of a balanced feed, and wherein the linking conductor is a balun sleeve, and the antenna elements of the first group extend between the feed coupling nodes and the rim of the sleeve.

8. An antenna according to claim 1, wherein the linking conductor has an electrical length of $\lambda_{g1}$, where $\lambda_{g1}$ is the guide wavelength of the rim at the first operating frequency.

9. An antenna according to claim 1, wherein the second operating frequency is below the first operating frequency.

10. An antenna according to claim 1, wherein, in respect of the antenna elements connected to each of the feed coupling nodes, the pattern formed by the antenna elements is such that the sequence of antenna elements of the first group and antenna elements of the second group is mirrored about a centre line associated with the pattern.

11. An antenna according to claim 1, wherein each said group of elongate conductive antenna elements has elements connected to one of the feed coupling nodes and elements connected to the other of the feed coupling nodes, the arrangement of the elements being such that, in respect the elements connected to each feed coupling node, (a) they comprise pairs of neighbouring antenna elements, with each pair comprising one element of the first group and one element of the second group, and (b) the number of said pairs in which, in a given direction around the core, the element of the first group precedes the element of the second group is equal to the number of said pairs in which, in the said direction, the element of the second group precedes the element of the first group.

12. A dielectrically loaded helical antenna for operation in first and second frequency bands above 500 MHz, which frequency bands have centre frequencies which are spaced apart by a least 5 percent of the mean of the two centre frequencies, wherein the antenna comprises a core made of a solid dielectric material which occupies the major part of the interior volume of the core defined by its outer surface, and an antenna element structure comprising a plurality of closed circuit substantially half-turn helical conductive elements defining a resonant frequency in the first band and a plurality of open-circuit substantially quarter-wave helical elements defining a resonant frequency in the second band.

13. A dielectrically loaded having first and second operating frequencies above 200 MHz, wherein the antenna comprises an electrically insulative dielectric core of a solid material that has a relative dielectric constant greater than 5 and occupies the major part of the interior volume defined by the core outer surface, which outer surface has oppositely directed transversely extending surface portions and a side surface portion between the transversely extending portions, wherein the antenna further comprises feed coupling nodes associated with one of the transversely extending portions, and an antenna element structure comprising at least one pair of conductive elongate antenna elements extending from the feed coupling nodes, over the side surface portion of the core towards the said other transversely extending surface portion, and terminating in open circuit ends, wherein each of the said elongate elements has an electrical length in the region of $(2n-1)\lambda_g/4$, where $\lambda_g$ is the guide wavelength along the elements at one of the operating frequencies and n is an integer.

14. An antenna according to claim 13, the antenna element structure comprises at least two pairs of the said conductive elongate antenna elements, and wherein the electrical lengths of the elements of one of the pairs of conductive elongate antenna elements are greater than those of the other pair.

15. An antenna according to claim 13, wherein the core is substantially cylindrical and the elongate antenna elements of the said two pairs are substantially helical and have a common central axis.

16. A backfire antenna according to claim 13.

17. An antenna according to claim 13, including a balun coupled to the feed coupling nodes.

18. An antenna according to claim 17, including a coaxial feed line through the core, and a balun sleeve encircling the core and connected to an outer screen of the feed line at the said other transversely extending surface portion of the core.

19. An antenna according to claim 13 for operation with circularly polarised radiation at both said operating frequencies.

20. A dielectrically loaded antenna for operation at frequencies above 200 MHz, wherein the antenna comprises:

a substantially cylindrical electrically insulative dielectric core of a solid material that has a relative dielectric constant greater than 5 and occupies the major part of the interior volume defined by the core outer surface, which outer surface has oppositely directed distal and proximal outer surface portions extending transversely with respect to a central axis of the core and a substantially cylindrical side surface portion between the transversely extending portions;

feed nodes located in the region of the distal outer surface portion of the core and forming a balanced feed termination;

an antenna element structure comprising at least one pair of open-circuit elongate conductive antenna elements which have electrical lengths in the region of $(2n-1)\lambda_g/4$, where $\lambda_g$ is the guide wavelength along the elements at an operating frequency of the antenna and n is an integer and which extend from the feed nodes via helical antenna element portions to respective open-circuit ends on the cylindrical side surface portion of the core;

a feed line in a passage extending through the core; and a balun connected to the feed line.

21. An antenna according to claim 20, having a single-ended feed connected in the region of the proximal outer surface portion of the core, wherein the balun comprises a conductive layer connected to the feed connection and extending over the core proximal outer surface portion and a proximal part of the core side surface portion to form a quarter-wave open-circuit stub at an operating frequency of the antenna.

22. An antenna according to claim 21, wherein the said balun conductive layer encircles the core to form an annular conductive path on the core side surface portion with an electrical length equal to a single guide wavelength along the path at an operating frequency of the antenna.

23. An antenna according to claim 19 for operation with circularly polarised radiation at the said operating frequency, wherein the antenna element structure comprises at least two pairs of the said conductive elongate antenna elements.

24. A dielectrically loaded antenna for operation in first and second frequency bands above 200 MHz, wherein the antenna comprises: an electrically insulative dielectric core of a solid material that has a relative dielectric constant greater than 5 and occupies the major part of the interior volume defined by the core outer surface, which outer surface has oppositely directed transversely extending surface portions and a side surface portion between the transversely extending portions, wherein the antenna further comprises a pair of feed coupling nodes associated with one of the transversely extending surface portions, and an antenna element structure comprising first and second groups of elongate conductive antenna elements, each group comprising at least four such antenna elements extending from the feed coupling nodes over the core side surface portion towards the other transversely extending surface portion, wherein the elements of the first group are longer than those of the second group whereby the elements of the first and second groups are respectively associated with first and second circular polarisation resonances of different resonant frequencies, and wherein each group of antenna elements has elements connected to one of the feed coupling nodes and elements connected to the other of the feed coupling nodes, the arrangement of the elements being such that, in respect the elements connected to each feed coupling node, (a) they comprise pairs of neighbouring antenna elements, with each pair comprising one element of the first group and one element of the second group, and (b) the number of said pairs in which, in a given direction around the core, the element of the first group precedes the element of the second group is equal to the number of said pairs in which, in the said direction, the element of the second group precedes the element of the first group.

25. An antenna according to claim 24, wherein, in respect of the elements connected to each feed coupling node, the elements of the said first group and those of the said second group are arranged in an alternating sequence around the side surface portion of the core.

26. An antenna according to claim 25, wherein the first group of antenna elements comprises six helical antenna elements and the second group of antenna elements comprises four helical elements.

* * * * *